US007788858B1

(12) United States Patent
Ammons

(10) Patent No.: US 7,788,858 B1
(45) Date of Patent: Sep. 7, 2010

(54) ALL TERRAIN VEHICLE WITH TELESCOPING CAMERA

(76) Inventor: Douglas D. Ammons, 238 Rose Dr., Brunswick, GA (US) 31520

( * ) Notice: Subject to any disclaimer, the term of this patent is extended or adjusted under 35 U.S.C. 154(b) by 525 days.

(21) Appl. No.: 11/818,814

(22) Filed: Jun. 18, 2007

(51) Int. Cl.
*B66C 23/44* (2006.01)

(52) U.S. Cl. ..... 52/118; 212/180; 212/292; 212/299; 212/302; 224/401; 224/511; 414/462

(58) Field of Classification Search ..... 52/118; 212/292, 294, 299, 302, 180; 224/511
See application file for complete search history.

(56) References Cited

U.S. PATENT DOCUMENTS 1,426,276 A * 8/1922 Christie ..... 52/28
3,463,916 A * 8/1969 De Bella ..... 52/28
3,495,364 A * 2/1970 De Bella ..... 52/118
4,419,038 A * 12/1983 Pendergraft ..... 414/543
4,913,458 A * 4/1990 Hamilton ..... 280/6.153
4,932,176 A * 6/1990 Roberts et al. ..... 52/118
5,129,199 A * 7/1992 Miller et al. ..... 52/121
5,171,124 A * 12/1992 Foster ..... 414/685
5,662,451 A * 9/1997 Muzzi et al. ..... 414/540
5,791,857 A * 8/1998 Ziaylek et al. ..... 414/462
5,975,831 A * 11/1999 Martin ..... 414/543
6,253,502 B1 * 7/2001 Layton ..... 52/118
6,371,314 B1 * 4/2002 Boisvert ..... 212/180
7,156,246 B2 * 1/2007 Sherrod ..... 212/180
7,420,587 B2 * 9/2008 Davis ..... 348/82
7,575,120 B2 * 8/2009 Beatty ..... 212/180

FOREIGN PATENT DOCUMENTS

EP 2020558 A1 * 2/2009
JP 8-81176 A * 3/1996

* cited by examiner

*Primary Examiner*—James Keenan
(74) *Attorney, Agent, or Firm*—Rodgers & Rodgers

(57) ABSTRACT

An all terrain vehicle having a vehicle frame with a boom frame attached to the vehicle frame, a saddle nest attached to the boom frame, a pivot saddle respectively secured to the boom frame, a telescoping boom secured in the pivot saddle, the pivot saddle comprising a post disposed adjacent and parallel to the telescoping boom, a locking sleeve slidably mounted on the post, and a latch formed on the vehicle frame with the locking sleeve and latch adapted to interlock to maintain the telescoping boom in an upright position.

8 Claims, 3 Drawing Sheets

ALL TERRAIN VEHICLE WITH TELESCOPING CAMERA

BACKGROUND OF THE INVENTION

Oftentimes it is necessary to take photographs or videos of real estate to which access is extremely limited. Sometimes the property is virtually inaccessible. In order to gain access to the property and obtain the desired photographs or video, known methods include the utilization of helicopters to fly over the property. Also, man lifts are employed which are essentially the equivalent of a crane wherein an individual is positioned in a bucket disposed at the end of the crane such that it can be extended over the property. These types of lifts are normally awkward to maneuver in position. Of course, helicopters and lifts are quite expensive with high hourly rental rates. Another method is to mount a camera on a conventional truck which also is very difficult to maneuver into position where the terrain is hilly and rocky.

BRIEF SUMMARY OF THE INVENTION

An all terrain vehicle includes a vehicle frame with a boom frame attached to the vehicle frame. A pivot saddle is pivotally connected to the boom frame and a telescoping boom is mounted within the pivot saddle with a camera disposed at the top of the telescoping boom. In the lowered position, the telescoping boom rests in a saddle nest mounted on the boom frame and in the extended position includes a post disposed adjacent and parallel to the telescoping boom with a locking sleeve slidably mounted on the post and with a latch formed on the vehicle frame to interlock with each other and maintain the telescoping boom in the extended position.

DETAILED DESCRIPTION OF THE INVENTION

Figure 1:
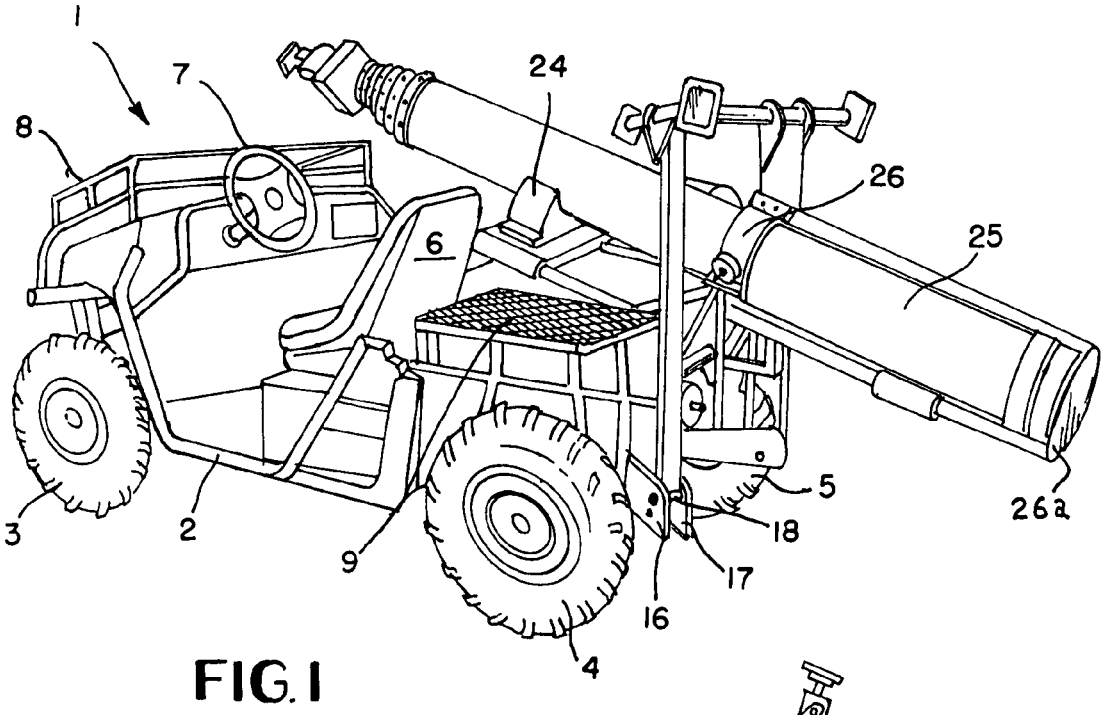
FIG. 1 is a perspective view of a telescoping camera mounted on an all terrain vehicle according to this invention.

In the drawings, the numeral 1 generally designates an all terrain vehicle (ATV). As is well known, the typical ATV includes vehicle frame 2, wheels 3, 4 and 5, with the right front wheel not shown in the drawings, seat 6 and steering wheel 7. The ATV also includes front-mounted storage rack 8 and rear-mounted work surface 9 which are attached to vehicle frame 2.

In order the stabilize the ATV due to its inherent instability when the camera is in an extended position, front leveling jack 10 is provided which is attached to bumper 11. In order to employ leveling jack 10, it is simply manually lowered to the point where the bottom thereof becomes firmly seated on the ground. Also, rear leveling jacks 12 and 13 are provided. Rear leveling jack 12 is mounted on the outer end of elongated outrigger 14 and, similarly, rear leveling jack 13 is mounted on the outer end of elongated outrigger 15. The inner end of outrigger 14 is mounted on brackets 16 and 17, secured to vehicle frame 2, and is pivotally connected thereto by means of pin 18, as best shown in FIG. 1. The same pivoting structure is employed in connection with rear leveling jack 13, but is not shown in detail in the drawings.

In order to position rear leveling jacks 12 and 13 for the purpose of stabilizing ATV 1, jacks 12 and 13 are lowered by means of manual cranks 19 and 20, respectively, such that foot pads 21 and 22 are securely seated on the ground. By the use of leveling jacks 10, 12 and 13, ATV 1 is maintained in a stable condition without the possibility of overturning even when positioned on uneven terrain.

Figure 4:
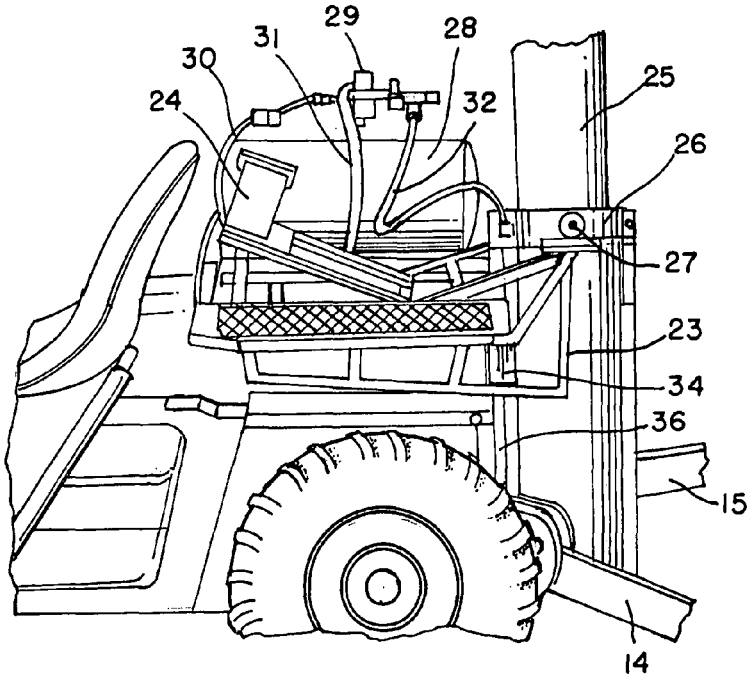
FIG. 4 is a partial side elevational view of the vehicle and telescoping boom mounting means.
Figure 5:
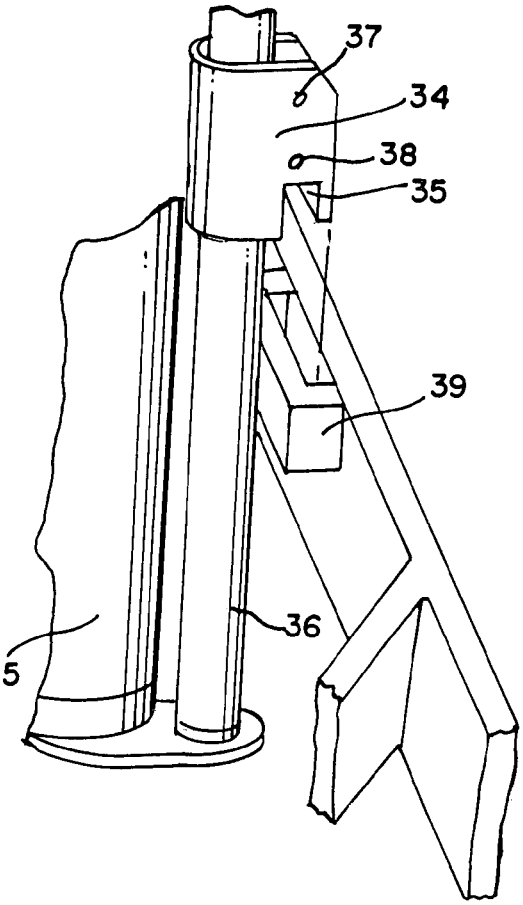
FIGS. 5 and 6 show the telescoping boom locking mechanism.
Figure 6:
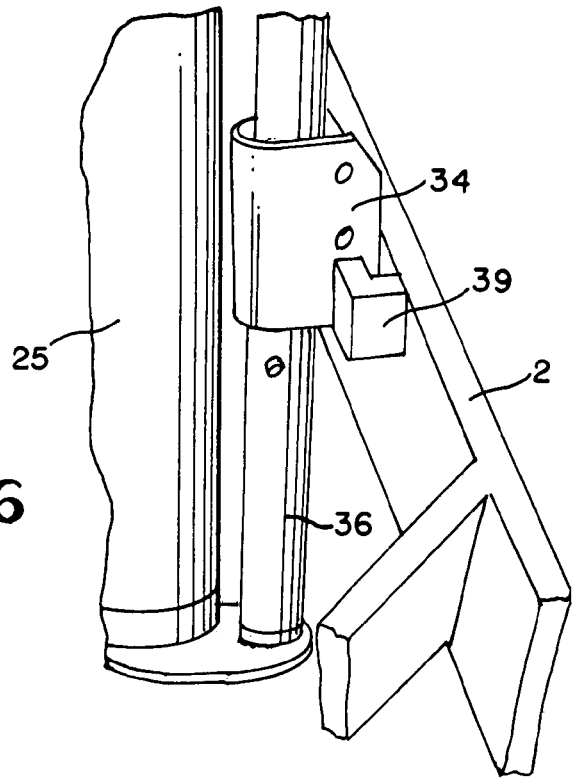

According to this invention and as best shown in FIG. 4, boom frame 23 is attached to ATV 1 by any conventional means such as welding and the like. Saddle nest 24 is mounted on boom frame 23 and telescoping boom 25 is mounted within an annular and elongated pivot saddle with pivot saddle collar 26 pivoted to boom frame 23 at pivot point 27.

Figure 3:
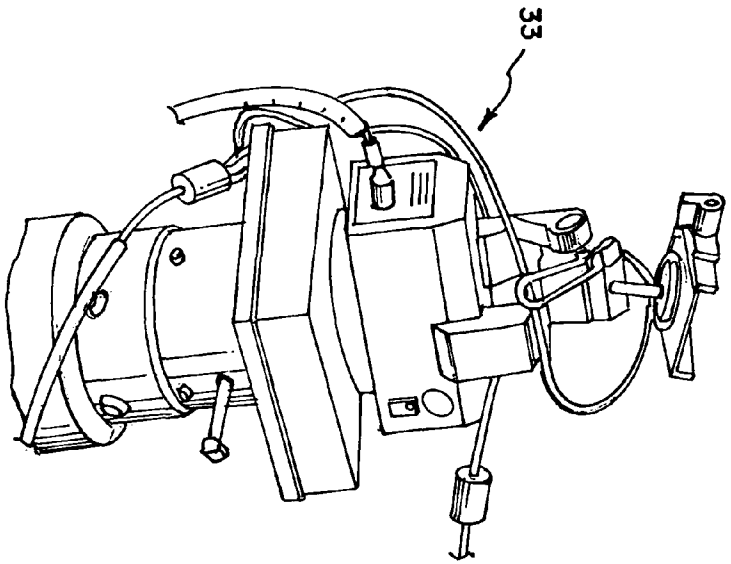
FIG. 3 is an enlarged perspective view of the camera.

For the purpose of extending telescoping boom 25, air tank 28 is interconnected to telescoping boom 25, in known manner, by means of valve 29 and air hoses 30, 31 and 32. In the drawings, a remote control camera, as generally indicated by the numeral 33, is mounted on the top of telescoping boom 25 and is shown in more detail in FIG. 3. Camera 33 is of conventional construction and can be either an image-capturing or video-capturing camera. It is capable of 360-degree rotation with a 45-degree tilt angle.

Figure 2:
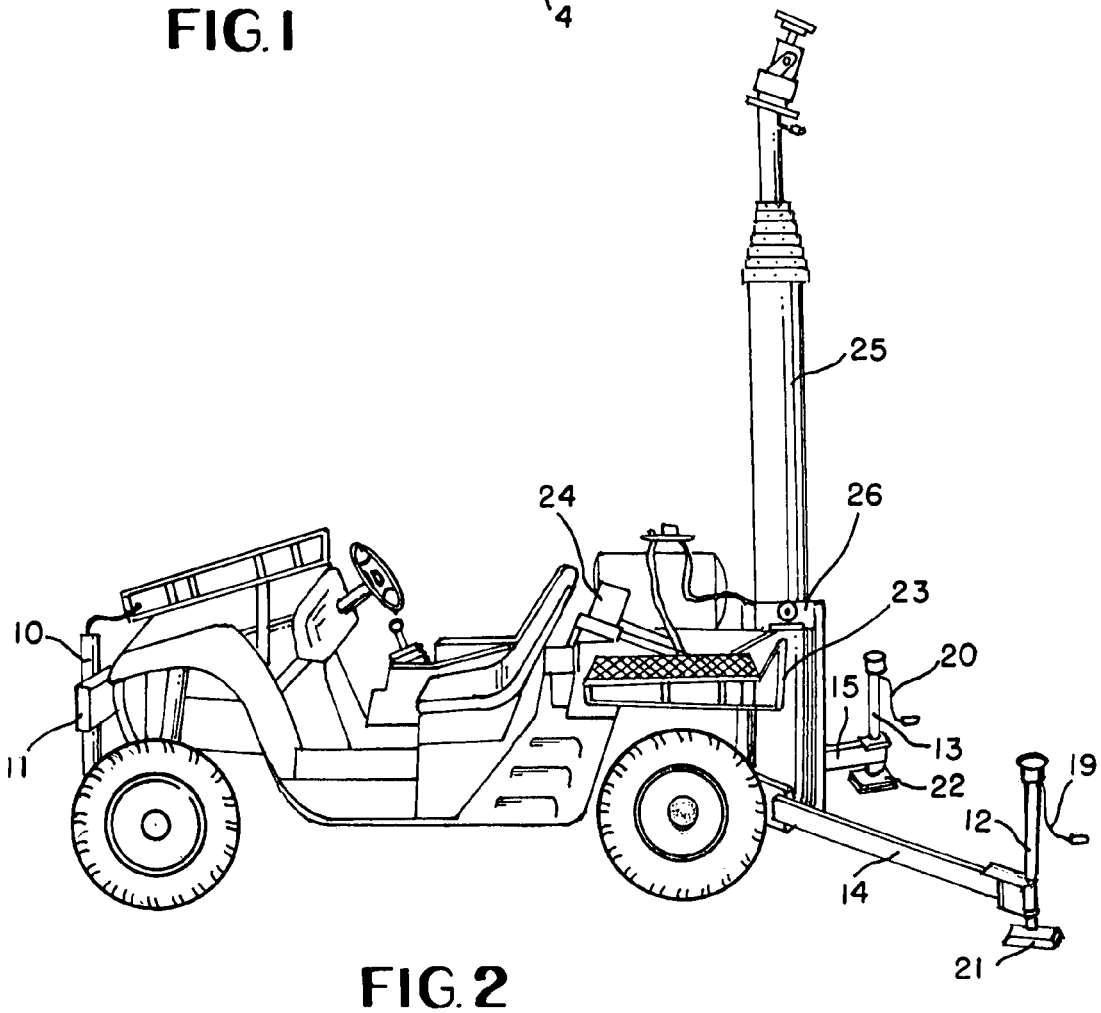
FIG. 2 is a side elevational view of the apparatus with the camera in an operating position.

In operation, with telescoping boom 25 in the position mounted on ATV 1 as shown in FIG. 2, air tank 28 is activated, in known manner, so as to extend telescoping boom 25 upwardly to a height sufficient to obtain the desired photographs or video from camera 33. In order to secure telescoping boom 25 in position, a locking mechanism is provided in the form of locking sleeve 34 which includes downwardly extending slot 35. Locking sleeve 34 is slidably mounted on post 36, which is an element of the structure of the pivot saddle 26 and is held on post 36 by means of pins 37 and 38. The pivot saddle includes multiple posts 36 which are attached at the top ends to pivot saddle collar 26 and at the bottom ends to pivot saddle bottom 26*a*. For purposes of providing locking cooperation with locking sleeve 34, latch 39 is welded to vehicle frame 2 of ATV 1. Therefore, when telescoping boom 25 is in the vertical position, locking sleeve 34 is simply manually maneuvered upwardly on post 36 and then lowered to a position whereby slot 35 is interlocked with latch 39.

When it is desired to move the apparatus to a different location, locking sleeve 35 is moved upwardly out of latch 39 and telescoping boom 25 is completely retracted into the position shown in FIG. 2 wherein it is then pivoted downwardly about pivot point 27 toward ATV 1 and positioned in saddle nest 24, as best shown in FIG. 1. Then front leveling jack 10 is manually raised as are rear leveling jacks 12 and 13 by means of manual cranks 19 and 20, respectively. Then rear leveling jacks 12 and 13 and outriggers 14 and 15 are simply swung upwardly to the positions shown in FIG. 1.

Therefore, by this invention, an ATV is provided which can access even the most remote locations and be positioned in a stable condition even when the camera-mounted telescopic boom is fully extended. After the desired photographs or video are taken, the telescoping boom is unlocked and quickly lowered to its storage position with the leveling jacks easily changed to positions for vehicle transport.

The invention claimed is:

1. An all terrain vehicle comprising a vehicle frame, a boom frame secured to said vehicle frame, a saddle nest mounted on said boom frame, an annular and elongated pivot saddle pivoted to said boom frame, a telescoping boom mounted within said pivot saddle, said pivot saddle comprising a pivot saddle collar encircling said telescoping boom and a pivot saddle bottom spaced from said pivot saddle collar, said pivot saddle collar and said pivot saddle bottom being interconnected by multiple posts, stabilizing means mounted on the front and rear of said vehicle, one of said posts disposed generally parallel and in proximity to said telescoping boom, a locking sleeve coaxially slidable on said post, a slot formed in said locking sleeve, a latch attached to said vehicle frame, a portion of said latch spaced from said vehicle frame, and said spaced portion of said latch being selectively disposed in said slot.

2. An all terrain vehicle according to claim 1, wherein a front-mounted storage rack is secured to said vehicle frame.

3. An all terrain vehicle according to claim 1, wherein a rear-mounted work surface is secured to said vehicle frame.

4. An all terrain vehicle according to claim 1, wherein a front bumper is mounted on said vehicle frame, said stabilizing means comprises front leveling means., and said front leveling means comprises a manually operable leveling jack attached to said front bumper.

5. An all terrain vehicle according to claim 1, wherein said stabilizing means comprises rear leveling means and said rear leveling means comprises a manually operable rear leveling jack.

6. An all terrain vehicle according to claim 5, wherein an elongated outrigger is secured to said vehicle frame at one end and said rear leveling jack is secured to the other end of said outrigger.

7. An all terrain vehicle according to claim 6, wherein a pair of brackets are secured to said vehicle frame and said outrigger is pivotally connected to said brackets at said one end.

8. An all terrain vehicle according to claim 1, wherein said telescoping boom is extended by pneumatic means.

* * * * *